United States Patent [19]

Van Sloun

[11] Patent Number: 4,487,128

[45] Date of Patent: Dec. 11, 1984

[54] SAFETY RING/FIRING PIN FOR EXPLOSIVE DEVICE

[75] Inventor: Peter H. Van Sloun, Hopkins, Minn.

[73] Assignee: Honeywell Inc., Minneapolis, Minn.

[21] Appl. No.: 432,588

[22] Filed: Oct. 4, 1982

[51] Int. Cl.[3] ..... F42C 15/22

[52] U.S. Cl. ..... 102/261; 102/487; 411/340

[58] Field of Search ..... 102/487, 486, 261, 260, 102/222, 221; 411/347, 352, 513, 340; 413/315, 316, 318

[56] References Cited

U.S. PATENT DOCUMENTS

| | | | |
|---|---|---|---|
| 1,213,397 | 1/1917 | Mills et al. | 102/261 |
| 1,517,810 | 12/1924 | Wiley | 102/261 |
| 2,402,693 | 6/1946 | Summerbell | 411/340 |
| 2,759,388 | 8/1956 | Annis | 411/347 |
| 3,132,556 | 5/1964 | Doering et al. | 411/340 |
| 3,289,521 | 12/1966 | Van Sloun | 403/315 X |
| 3,765,337 | 10/1973 | Padula | 102/487 |
| 3,782,288 | 1/1974 | Berlin et al. | 102/487 |
| 4,036,097 | 7/1977 | Greenwood | 411/340 |

*Primary Examiner*—David H. Brown
*Attorney, Agent, or Firm*—Roger W. Jensen

[57] ABSTRACT

A firing pin/safety ring for a portable explosive device characterized by the firing pin being positionable in a wide range of angular positions with respect to the plane of the safety ring.

1 Claim, 5 Drawing Figures

FIG. 1
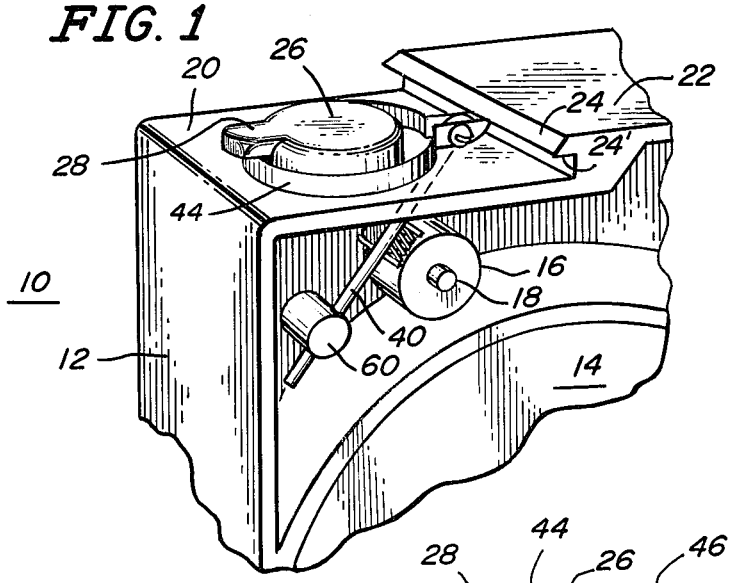
FIG. 5
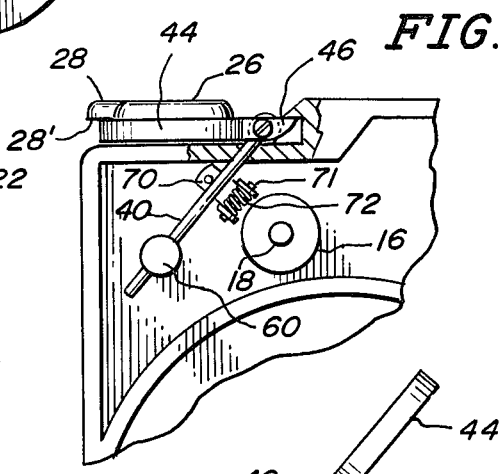
FIG. 2
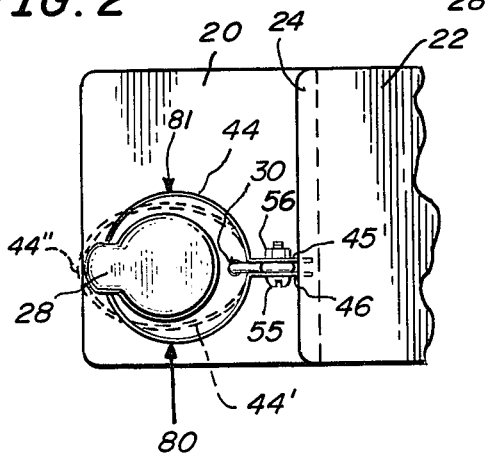
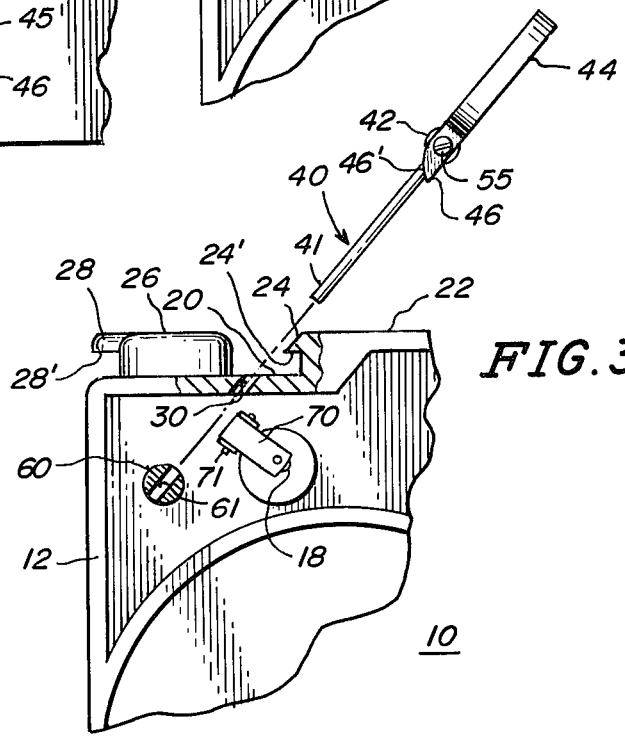
FIG. 3
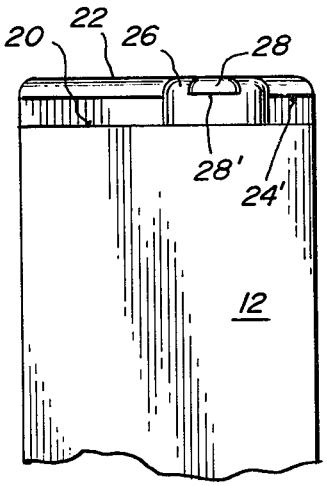
FIG. 4

SAFETY RING/FIRING PIN FOR EXPLOSIVE DEVICE

BACKGROUND OF THE INVENTION

In the field of portable explosive devices such as hand grenades, pocket mines and the like, various safety schemes have been utilized in the prior art for preventing premature detonation/explosion. An example of such a prior art arrangement is the present applicant's earlier U.S. Pat. No. 3,289,521, patented Dec. 6, 1966.

SUMMARY OF THE INVENTION

The present invention is an improvement over said U.S. Pat. No. 3,289,521, which is limited to an apparatus wherein a securing pin/retaining ring is adapted to encompass the shaft through which the firing pin is inserted. The aforesaid limitation is not present in this invention, which is characterized by a safety pin positionable in a wide range of angular positions with respect to the plane of a retaining ring.

BRIEF DESCRIPTION OF THE DRAWINGS

FIG. 1 depicts an isometric view of a portion of an explosive device utilizing the present invention;

FIG. 2 is a top view of the apparatus shown in FIG. 1;

FIG. 3 is a side view of the apparatus shown in FIG. 1 with the safety pin removed;

FIG. 4 is an end view of the apparatus shown in FIG. 3; and

FIG. 5 is a side view of the apparatus shown in FIG. 1.

DESCRIPTION OF THE PREFERRED EMBODIMENT

Referring to FIG. 1, the reference numeral 10 designates an explosive device comprising in part a housing member 12 and a shaft 60 mounted on the housing member by means, not shown, which permit the shaft 60 to rotate relative to the housing, the rotational axis being perpendicular to the plane of the paper for FIGS. 3 and 5.

The explosive device 10 further includes, as part of housing 12, a chamber 14 for the storage of explosive material and a battery assembly 16. Centrally located on the battery assembly 16 is a battery primer or applicator 18. The chamber 14 and the battery assembly 16 are not directly associated with the present invention but are shown for completeness of this disclosure.

The housing 12 further includes a top surface 20 having centrally positioned therein a circularly shaped projection 26, the projection 26 further comprising a radially extending lock tang 28. The top surface of the housing 12 to the right of surface 20, as depicted in FIG. 1, is elevated above the level of surface 20, the elevated surface being identified by reference numeral 22 and the left-hand edge as depicted in FIG. 1 being projected out over surface 20 in the form of an overhanging shoulder 24, the under surface of which is identified by reference numeral 24'.

As aforesaid, the invention provides means for locking shaft 60 against any movement, i.e., rotation relative to housing 12 and, when desired, for unlocking said shaft so as to permit movement, i.e., rotation of the shaft, so as to initiate ignition of explosive material in the housing member. The shaft locking/unlocking apparatus comprises a first circular cylindrical bore 61 through shaft 60 (see FIG. 3) and a second circular cylindrical bore 30 through the top portion 20 of the housing 12. The locking/unlocking apparatus further comprises an elongated safety pin 40 having a circular cross-section and a diameter slightly less than that of said bores 61 and 30. The safety pin 40 is normally positioned so that one end portion thereof is in said first bore 61 and the other end portion thereof is in the second bore 30.

The locking/unlocking apparatus further includes a flexible circular retaining ring 44 formed from a strip of resilient material, the two ends of said strip being identified by reference numerals 45 and 46 (see FIG. 2) and said two ends having curved camming surfaces, the camming surface for end 46 being shown in FIG. 3 and identified by reference numeral 46'. The ends 45 and 46 of the strip of resilient material are pivotally connected to opposite sides of the other end of the safety pin, this means being depicted in the drawings as a machine screw 55 passing through an aperture at the end of the safety pin and secured with a nut 56. The normal position for the retaining ring 44 is that depicted in FIGS. 1, 2, and 5, i.e., with the plane of the ring parallel to the top surface of the housing 12 and with one axial edge of the ring abutting said top surface 20, one circumferential part of the ring being positioned under the lock tang 28 and the two ends 45 and 46 being positioned under the overhanging shoulder 24, i.e., in substantial abutting relationship with the under surface 24' of the shoulder 24, all of the foregoing being clearly depicted in FIG. 5 wherein it is seen that the undersurface of the lock tang 28' projects to the left beyond the ring 44 with the ends 45 and 46 being held against upward movement by the shoulder 24; the ring is thereby locked in the position shown.

In FIG. 5 is shown a lever member 70 pivoted at 71 and connected to a spring 72 which is adapted to move lever 70 about its pivotal axis when the safety pin 40 is removed from the housing. Removal of the safety pin (as is depicted in FIG. 3) will permit the lever 70 to rotate about its pivotal axis 71 so as to impact the activator 18 associated with the battery.

When it is desired to remove the safety ring and safety pin from the device 10, radial pressure is applied from diametrically opposite points on the ring 44, this being illustrated by arrows 80 and 81 in FIG. 2. This flexes the ring 44 form its normal circular configuration to an oblong or oval configuration identified by reference numeral 44' in FIG. 2 which thus causes outward movement of the end 44'' of ring 44 furthest away from the pivotal connection 55/56 so that end 44'' may be lifted upwardly around the lock tang 28. As this lifting takes place, the camming surfaces of ends 45 and 46 coact with the top surface 20 of housing 12 so as to initiate an axial motion of said safety pin 40 out of the bores 61 and 30. The axial motion is continued by application of manual force applied to the safety pin through the ring 44 along the axis of the pin. Once the pin is withdrawn from shaft 60, the shaft 60 is unlocked and may be rotated with respect to the housing 12 so as to permit the ignition of explosive material. As the pin is further withdrawn completely from the housing 12, the lever 70 may rotate about its axis 71 so as to impact the activator 18.

While I have described a preferred embodiment of the invention, it will be understood that the invention is limited only by the scope of the following claims.

I claim:

1. A device comprising in part one fixed member locked to a second movable member by means of a pin passing through both said members and a locking and unlocking means to control the position of said pin, said locking and unlocking means comprising:

(a) a first bore through said fixed member;

(b) a second bore through said movable member;

(c) said pin having a cross-section less than that of said bores, and normally positioned so that (i) one end portion is in first said bore and (ii) the other end portion thereof is in second said bore;

(d) a lock tang spaced from said first bore;

(e) an overhanging shoulder means adjacent to said first bore opposite from said lock tang; and (f) a flexible circular locking and unlocking ring formed from a strip of resilient material, the two ends of said strip (i) having ends which normally engage said overhanging shoulder and (ii) being pivotally connected to opposite sides of the end of said pin, the circumferential side of said ring opposite from said pin attachment side normally being positioned under said lock tang and the ends of said ring being positioned under said overhanging shoulder, the said ring thereby being captivated by said lock tang, said shoulder, said pin, and said fixed member; said ring, upon radial pressure applied from diametrically opposite points between said lock tang area and said overhang area, being distorted so that said circumferential side thereof may be lifted over said tang; thereafter further lifting of said ring causing a rotation thereof about said pivotal connection causing said ends of said ring to become spread away from said overhanging shoulder; thereafter said pin being manually extracted from both said bores to complete unlocking of said second movable member from said first fixed member.

* * * * *